United States Patent [19]

Bianchi

[11] 4,053,259

[45] Oct. 11, 1977

[54] AXIAL FAN ADJUSTABLE PITCH CONNECTABLE BLADES

[75] Inventor: Emilio Bianchi, Varese, Italy

[73] Assignee: Axial International Establishment, Mauren, Liechtenstein

[21] Appl. No.: 626,067

[22] Filed: Oct. 28, 1975

[30] Foreign Application Priority Data

| | | |
|---|---|---|
| Oct. 31, 1974 | Italy | 29044/74 |
| Oct. 14, 1975 | Italy | 28250/75 |

[51] Int. Cl.[2] ..... F04D 29/36

[52] U.S. Cl. ..... 416/208; 416/214 R

[58] Field of Search ..... 416/207, 208, 214 A, 416/224, 226, 232

[56] References Cited

U.S. PATENT DOCUMENTS

| | | | |
|---|---|---|---|
| 1,816,317 | 7/1931 | Dicks | 416/207 |
| 2,232,670 | 2/1941 | Barrett | 416/207 |
| 2,307,490 | 1/1943 | Curley | 416/207 |
| 2,573,875 | 11/1951 | Riddiford | 416/207 |
| 2,620,884 | 12/1952 | Gluhareff | 416/226 |
| 2,765,859 | 10/1956 | Hartzell et al. | 416/207 |
| 3,130,677 | 4/1964 | Liebhart | 416/207 X |
| 3,161,239 | 12/1964 | Andersen | 416/214 |
| 3,167,129 | 1/1965 | Shultz | 416/226 |
| 3,545,885 | 12/1970 | Killam | 416/207 |

FOREIGN PATENT DOCUMENTS

| | | | |
|---|---|---|---|
| 1,059,290 | 6/1959 | Germany | 416/208 |
| 638,856 | 6/1950 | United Kingdom | 416/208 |

*Primary Examiner*—Everette A. Powell, Jr.
*Attorney, Agent, or Firm*—Kurt Kelman

[57] ABSTRACT

The hub of an axial-flow fan is constituted by two shell members axially juxtaposed for driven rotation about a common first axis. Circumferentially distributed ribs project from each shell member toward ribs on the other shell member, each pair of ribs being formed with cylindrically arcuate, respective seating faces about a common second axis transverse to the first axis, the seating faces jointly receiving a conforming root portion of a blade whose wing portion projects radially beyond the hub. The shell members and root portions are releasably clamped to each other by a clamping bolt axially passing through aligned openings in the shell members, the ribs, and the root portions, one clamping bolt constituting the sole element securing each blade to the hub so that individual blades may be released by removing one bolt only.

6 Claims, 7 Drawing Figures

AXIAL FAN ADJUSTABLE PITCH CONNECTABLE BLADES

This invention relates to an axial flow fan having releasably mounted blades of adjustable pitch.

Conventional fans having fixed blades are designed for effective operation in a specific range of pressures and volumes only. Different fans must be used under different conditions unless a fan is equipped with a variable speed drive, such as a relatively costly variable-speed motor or a space-consuming belt drive.

The invention provides an axial-flow fan which is readily adjusted for different operating conditions. It comprises two shell members which may be driven about a common first axis in axially juxtaposed position. Circumferentially distributed ribs project frm each shell member toward respective opposite ribs on the other shell member, each rib having a seating face of circularly arcuate cross section about a second axis transverse to the first axis. The root portion of each of a plurality of elongated blades is interposed between two associated, opposite ribs, and the wing portion of each blade projects radially outward beyond the shell members. The shell members and root portions are clamped to each other in a position in which each root portion is fixedly secured in conforming engagement with the seating faces of the associated ribs by a plurality of clamping members, each passing axially through aligned respective openings in the shell members, two opposite ribs, and the associated root portion.

The invention will be described by way of example with reference to the accompanying drawing in which.

Figures 1, 2, 3:
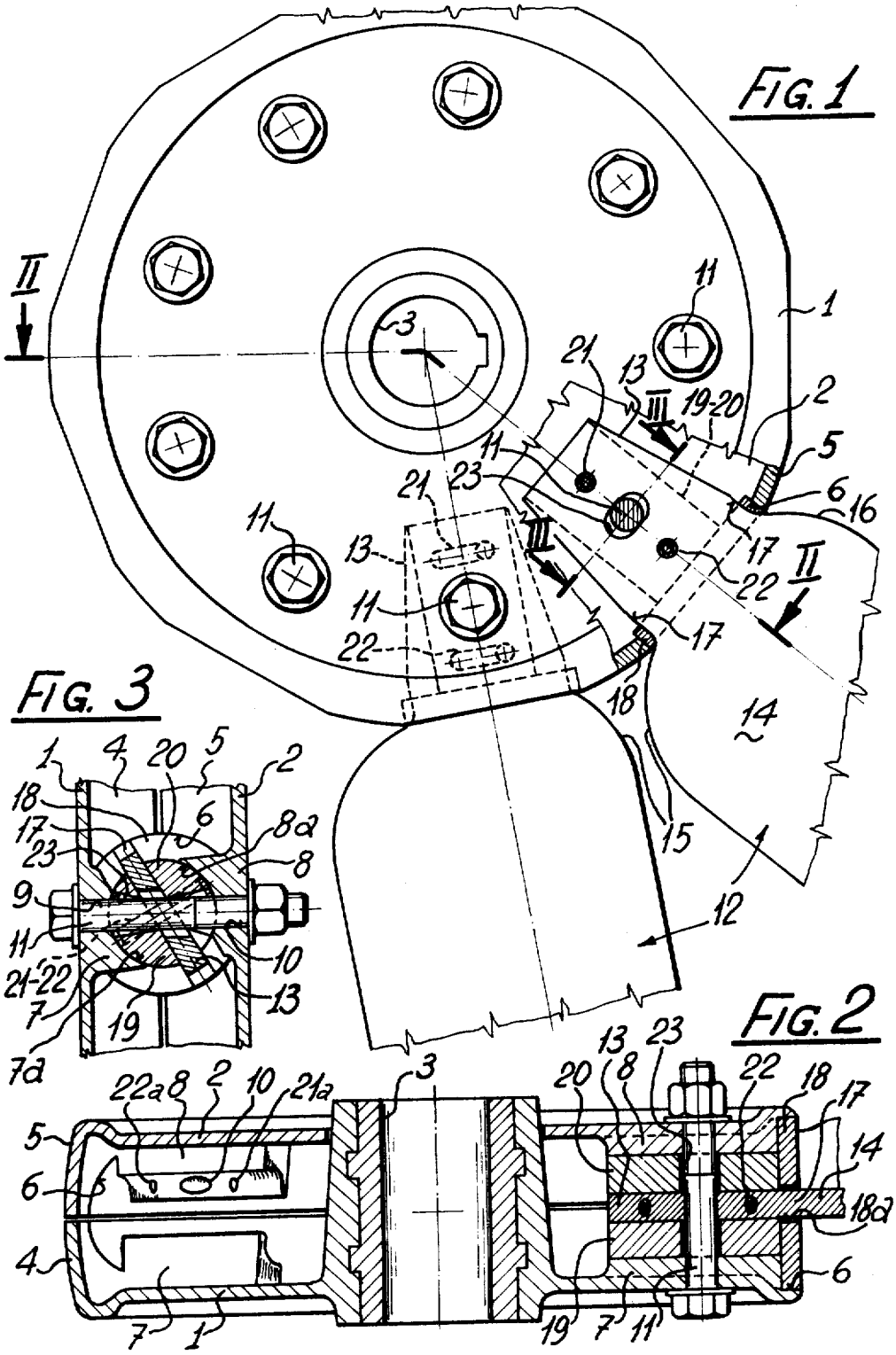
FIG. 1 shows a fan of the invention in fragmentary front elevation, and partly in section.
FIGS. 2 and 3 show the fan of FIG. 1 in respective sections on the lines II—II and III—III.
Figure 4:
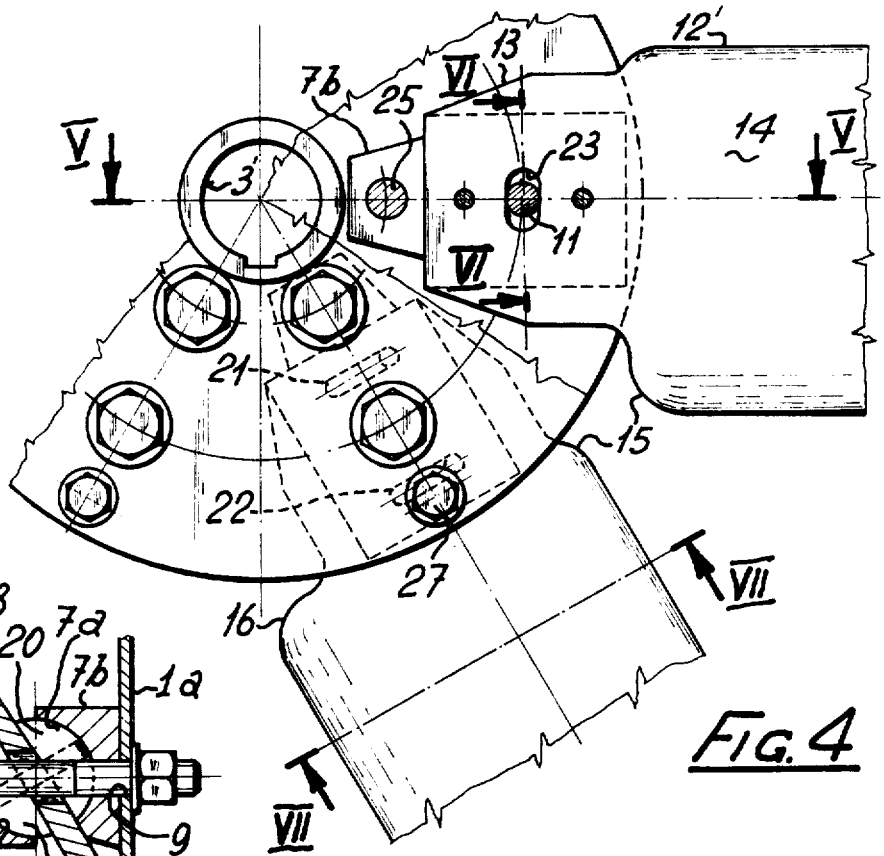
FIG. 4 shows a variant of the fan of FIG. 1 in a corresponding view.
Figure 6:
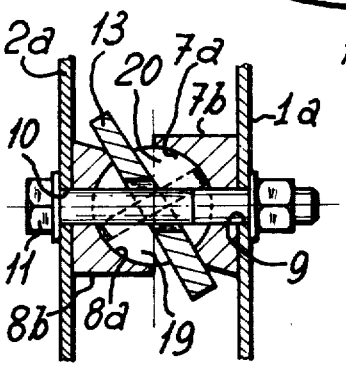
FIGS. 5 to 7 illustrate the fan of FIG. 4 in respective sections on the lines V—V, VI—VI, and VII—VII.

The hub of the fan shown in FIGS. 1 to 3 has two circular shell members 1, 2. The shell member 1 is fixedly fastened to a drive sleeve 3 coaxially passing through the shell member 2. Flanges 4, 5 project axially toward each other from the outer circumferences of the identical shell members 1, 2 and are each formed with nine, equiangularly spaced, semicircular notches axially aligned with corresponding notches on the other flange to constitute radially open, circular apertures 6 in the hub. Nine integral ribs 7, 8 project axially from each shell member 1, 2 toward opposite ribs on the other shell member. The ribs of each pair of opposite ribs have respective seating faces 7*a*, 8*a* of cylindrically arcuate shape about an axis radial relative to the aforementioned axis of rotation and centrally passing through an associated aperture 6. Axial bores 9, 10 in each shell member 1, 2 and the associated ribs 7, 8 are axially aligned, and each set of aligned bores receives a clamping bolt 11 which holds the shells and ribs in the illustrated position of clamping engagement with a fan blade 12, only two of the nine blades being shown in FIG. 1.

Each blade has a root portion 13 clamped between the seating faces 7*a*, 8*a* of a pair of ribs 7, 8, as will presently be described, and a wing portion 14 which projects radially beyond the shell members 1, 2. The radially inner part of each wing portion 14 tapers in curved shoulders 15, 16 toward an integral flat part 17 of rectangular, elongated cross section evident from FIGS. 2 and 3 which is conformingly received in an opening 18*a* of a circular closing disc 18 in the aperture 6 through which the blade 12 passes.

Each part 17 projects radially inward from the associated closing disc 18 between two members 19, 20 having each the shape of a cylinder segment and conformingly engaging the seating faces 7*a*, 8*a* of ribs 7, 8 respectively. The projecting inner portion of each flat part 17 and the associated segmental members 19, 20 jointly constitute the root portion 13 of a blade 12 and are fastened to each other by taper pins 21, 22 in aligned bores 21*a*, 22*a*.

The bolt 11 connecting the ribs 7, 8 passes through an oversized bore 23 in the root protion 13 with sufficient clearance to permit angular displacement of the wing 12 about the common axis of the seating faces 7*a*, 8*a* when the nut on the bolt 11 is loosened.

The fan is assembled by placing a closing disc 18 on each blade 14, thereafter installing the segmental members 19, 20 on the flat portion 17, and inserting the sub-assembly so formed between two juxtaposed shell members 1, 2 into the seating faces 7*a*, 8*a* of opposite ribs. The assembly then is clamped together by means of a bolt 11.

Before the nuts are tightened on each bolt, the pitch of each blade is adjusted. If not all apertures 6 are occupied by inserted blades 12, the idle apertures may be blocked by discs 18. The tightened bolts 11 provide sufficient friction on the several interfaces to hold the fan in the desired condition.

All elements of the fan are under axial compressive stress, and there is no bending or shearing stress in the assembly. The frictional fit is sufficiently strong to absorb the centrifugal forces acting on the rotating blades, and the bolts 11 provide secure anchorage for the blades even when loosened accidentally. When the bolts are loosened, the pitch of the blades may be changed. Individual blades may be removed or replaced after removal of the associated bolts only without further disassembly of the hub.

In the modified fan shown in FIGS. 4 to 7, the hub is mainly formed by two axially juxtaposed annular discs 1*a*, 2*a* of sheet material to whose opposite radial faces ribs 7*b*, 8*b* are fastened by means of screws 26, 27. Each pair of opposite ribs has seating faces 7*a*, 8*a* which are cylindrically arcuate about a common axis *y* inclined at a small, acute angle *a* relative to a plane *x* perpendicular to the axis of rotation to which the discs 1*a*, 2*a* are symmetrical.

The root portion 13 of a blade 12' is mounted between the seating faces 7*a*, 8*a* by a bolt 11 as described above, and additionally by a bolt 25 passing through the discs 1*a*, 2*a* and a radial flange on a drive sleeve 3' which contributes clamping pressure to that supplied by the bolt 11. The open peripheral gaps between the discs 1*a*, 2*a* may be filled with cellular material in a manner not illustrated.

Figure 5:
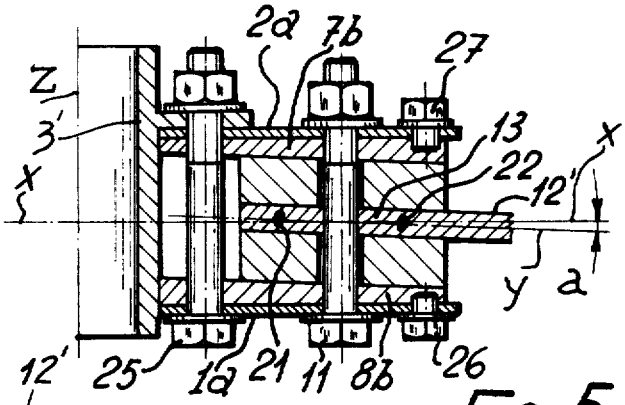

The reaction to air resistance oppositing rotation of the blades 12' is directed downward, as viewed in FIG. 5, and generates a clockwise movement at the root portions of each blade. Because the blade axis *y* slopes downward from the axis of rotation, the blades center of gravity is below the plane *x*, and the centrifugal force acting on the center of gravity has an upward axial component causing a counterclockwise movement at the root portion of the blade which reduces or balances the effect of air resistance.

Figure 7:
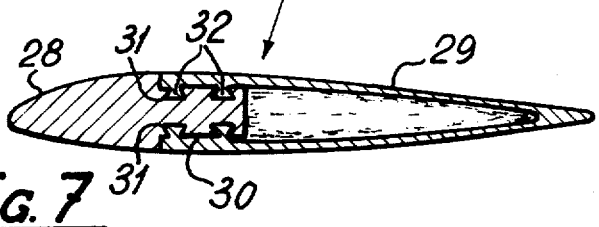

As is best seen in FIG. 7, the blade 12' is of a type preferred for large fans. It consists of two extruded sections 28, 29 connected by a film of adhesive 30 between engaged faces of the two sections. The trailing section 29 is hollow and carries ribs 32 which are conformingly received in dove-tailed grooves 31 of the solid, leading section 28. After assembly of the blade sections and prior to curing of the adhesive, the assembled sections are twisted into the desired shape. The solid section 28 extends into the root portion 13. The center of gravity of the blade 12' is farther forward than in an otherwise similar solid blade, and vibration is reduced.

What I claim is:

1. A fan comprising:

a. a first shell member having a first axis;

b. drive means for rotating said shell member about said axis;

c. a second shell member axially juxtaposed to said first shell member;

d. a plurality of circumferentially distributed ribs projecting from each shell member toward respective, opposite ribs on the other shell member;

1. each rib having a seating face of circularly arcuate cross section about a second axis transverse to said first axis;

e. a plurality of elongated blade members having each a root portion and a wing portion, 1. said root portion being of circularly arcuate cross section and interposed between two associated, opposite ribs, 2. said wing portion projecting radially outward relative to said first axis beyond said shell members; and f. releasable clamping means axially clamping said shell members and said root portions to each other in a position in which each root portion is fixedly secured in conforming engagement between the seating faces of the associated ribs, 1. said clamping means including a plurality of clamping members, each clamping member axially passing through aligned respective openings in said shell members, two opposite ribs, and the associated root portion.

2. A fan as set forth in claim 1, wherein said clamping member passes through the opening in said root portion with sufficient clearance to permit angular displacement of said root portion relative to the associated ribs about said second axes without removal of said clamping member when said clamping means is released.

3. A fan as set forth in claim 2, wherein the second axes of the seating faces of the two ribs associated with the same root portion coincide in said position.

4. A fan as set forth in claim 3, wherein not more than one clamping member passes through each root portion, the associated opposite ribs, and said shell members.

5. A fan as set forth in claim 3, wherein said second axes are inclined at a small acute angle relative to a plane perpendicular to said first axis.

6. A fan as set forth in claim 1, wherein said shell members are identical and symmetrical relative to a plane perpendicular to said first axis when in said position.

* * * * *